US009076326B2

(12) United States Patent
Maji et al.

(10) Patent No.: US 9,076,326 B2
(45) Date of Patent: Jul. 7, 2015

(54) SYSTEMS AND METHODS FOR TRAFFIC PRIORITIZATION

(71) Applicant: Honeywell International Inc., Morristown, NJ (US)

(72) Inventors: Sanjib Kumar Maji, Bangalore (IN); Satyanarayan Kar, Bangalore (IN); Jitender Kumar Agarwal, Muzaffarnagar (IN); Sandeep Chakraborty, Kalkata (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 116 days.

(21) Appl. No.: 13/772,985

(22) Filed: Feb. 21, 2013

(65) Prior Publication Data

US 2014/0232559 A1 Aug. 21, 2014

(51) Int. Cl.
*G08G 1/00* (2006.01)
*G08G 5/00* (2006.01)

(52) U.S. Cl.
CPC ..... *G08G 5/0004* (2013.01); *G08G 5/0021* (2013.01); *G08G 5/0078* (2013.01)

(58) Field of Classification Search
CPC ..... G08G 5/0021; G08G 5/0043; G08G 5/02; G08G 5/025; G08G 5/0004; G08G 5/0078; G01C 23/00; G05D 1/0676
USPC ..... 340/901, 945, 961, 969–971, 977–978; 715/771; 701/118–120
See application file for complete search history.

(56) References Cited

U.S. PATENT DOCUMENTS

| | | | | |
|---|---|---|---|---|
| 4,424,038 | A * | 1/1984 | Tingleff et al. | 434/2 |
| 4,853,700 | A * | 8/1989 | Funatsu et al. | 342/30 |
| 5,017,142 | A * | 5/1991 | Bemis et al. | 434/220 |
| 5,945,926 | A * | 8/1999 | Ammar et al. | 340/970 |
| 6,950,037 | B1 | 9/2005 | Clavier et al. | |
| 7,194,342 | B1 * | 3/2007 | Horvath et al. | 701/3 |
| 7,747,360 | B2 * | 6/2010 | Canu-Chiesa et al. | 701/3 |
| 7,755,516 | B2 * | 7/2010 | Clark et al. | 340/961 |
| 8,060,295 | B2 | 11/2011 | Estkowski et al. | |

(Continued)

OTHER PUBLICATIONS

EP Search Report for Application No. 14153118.6, Dated Jun. 18, 2014.

(Continued)

*Primary Examiner* — Benjamin Lee
*Assistant Examiner* — Quang D Pham
(74) *Attorney, Agent, or Firm* — Ingrassia Fisher & Lorenz, P.C.

(57) ABSTRACT

Methods and apparatus are provided for traffic prioritization of surrounding air traffic for display onboard an aircraft. The apparatus includes a traffic data source configured to supply surrounding traffic data. The apparatus includes a traffic control module coupled to receive user selection data from the user input device and the surrounding traffic data. The traffic control module can be configured to determine a prioritization zone for prioritizing the surrounding air traffic to identify air traffic preceding the aircraft based on the user selection data, the range and the vertical speed of the surrounding air traffic, and set first traffic data that includes the surrounding air traffic within the prioritization zone listed by priority and second traffic data that includes the surrounding air traffic outside of the prioritization zone listed in received sequence. The apparatus displays a graphical user interface that includes the first traffic and the second traffic data.

18 Claims, 9 Drawing Sheets

(56) References Cited

U.S. PATENT DOCUMENTS

| | | | | |
|---|---|---|---|---|
| 8,160,755 | B2 * | 4/2012 | Nichols et al. | 701/3 |
| 8,185,256 | B2 * | 5/2012 | Herman | 701/3 |
| 8,195,347 | B2 * | 6/2012 | Boorman | 701/16 |
| 2005/0024237 | A1 * | 2/2005 | Gannett | 340/967 |
| 2008/0103641 | A1 * | 5/2008 | Ratcliffe | 701/3 |
| 2008/0103691 | A1 * | 5/2008 | Chen et al. | 701/207 |
| 2008/0163093 | A1 * | 7/2008 | Lorido | 715/771 |
| 2008/0195309 | A1 * | 8/2008 | Prinzel, III et al. | 701/208 |
| 2008/0198041 | A1 * | 8/2008 | Sallier et al. | 340/978 |
| 2008/0281522 | A1 * | 11/2008 | Subelet | 701/301 |
| 2009/0143968 | A1 | 6/2009 | Truitt | |
| 2010/0152931 | A1 * | 6/2010 | Lacombe et al. | 701/8 |
| 2010/0191467 | A1 * | 7/2010 | Wise et al. | 701/301 |
| 2011/0006918 | A1 * | 1/2011 | Shafaat et al. | 340/945 |
| 2011/0196598 | A1 * | 8/2011 | Feyereisen et al. | 701/120 |
| 2011/0276198 | A1 * | 11/2011 | Khatwa et al. | 701/3 |
| 2012/0215388 | A1 | 8/2012 | Pepitone et al. | |
| 2013/0006511 | A1 * | 1/2013 | Ramaiah et al. | 701/120 |
| 2013/0009792 | A1 * | 1/2013 | Shafaat | 340/979 |
| 2013/0066543 | A1 * | 3/2013 | Agarwal et al. | 701/120 |
| 2013/0166189 | A1 * | 6/2013 | Michel et al. | 701/120 |
| 2013/0179059 | A1 * | 7/2013 | Otto et al. | 701/120 |
| 2013/0204523 | A1 * | 8/2013 | He et al. | 701/527 |
| 2013/0211701 | A1 * | 8/2013 | Baker et al. | 701/120 |
| 2013/0345905 | A1 * | 12/2013 | Parthasarathy | 701/3 |
| 2014/0070965 | A1 * | 3/2014 | Letsu-Dake | 340/971 |
| 2014/0097972 | A1 * | 4/2014 | Barraci et al. | 340/971 |
| 2014/0104080 | A1 * | 4/2014 | Maddanimath et al. | 340/945 |
| 2014/0156109 | A1 * | 6/2014 | Estkowski | 701/2 |
| 2014/0163784 | A1 * | 6/2014 | Parthasarathy | 701/15 |
| 2014/0197981 | A1 * | 7/2014 | Hartley et al. | 342/37 |
| 2014/0197982 | A1 * | 7/2014 | Wang et al. | 342/37 |
| 2014/0210648 | A1 * | 7/2014 | Samuthirapandian et al. | 340/961 |
| 2014/0240148 | A1 * | 8/2014 | Krishnamurthy et al. | 340/971 |
| 2014/0249701 | A1 * | 9/2014 | Latsu-Dake et al. | 701/14 |
| 2014/0266807 | A1 * | 9/2014 | Behara et al. | 340/969 |
| 2014/0297169 | A1 * | 10/2014 | Le et al. | 701/121 |
| 2014/0300495 | A1 * | 10/2014 | Scheu et al. | 340/961 |
| 2014/0302881 | A1 * | 10/2014 | Williams | 455/509 |
| 2014/0303815 | A1 * | 10/2014 | Lafon et al. | 701/3 |
| 2014/0306950 | A1 * | 10/2014 | Russi et al. | 345/419 |
| 2014/0309817 | A1 * | 10/2014 | Burgin et al. | 701/3 |

OTHER PUBLICATIONS

EP Examination Report for Application No. 14153118.6, Dated Jul. 7, 2014.

Domino, D. A. et al.: "CDTI Enabled Delegated Separation (CEDS) in the Vertical Domain: Initial Feasibility Assessment" 2012 Integrated Communications Navigation and Surveillance (ICNS) Conference Apr. 24-26, 2012, Herndon, VA; Publisher: IEEE, Piscataway, NJ; Publication Date: 2012.

Mundra, A. M., et al.: "Feasibility and Benefits of a Cockpit Traffic Display-Based Separation Procedure" Eighth USA/Europe Air Traffic Management Research and Development Seminar (ATM2009); MITRE Corp, McLean, VA; http://www.atmseminarus.org/seminarContent/seminar8/papers/p_061_CDA.pdf.

McAnulty, M. D. et al.: "Pilot-Based Spacing and Separation on Approach to Landing: The Effect on Air Traffic Controller Workload and Performance" Federal Aviation Administration William J. Hughes Technical Center, DOT/FAA/CT-05/14; Dec. 2005; http://www.tc.faa.gov/its/worldpac/techrpt/ct05-14.pdf.

Bone, R. S., et al.: "Flight Crew Use of a Traffic Display to Supplement Visual Separation during Night Visual Approaches" Conference: The 23rd Digital Avionics Systems, Oct. 24-28, 2004, Salt Lake City, UT; Publisher: IEEE, Piscataway, NJ; Publication Date: 2004; pp. 4.A.2-1-13 vol. 1.

Conway, S. R., et al.: "A Method of Separation Assurance for Instrument Flight Procedures at Non-Radar Airports" American Institute of Aeronautics and Astronautics; http://www.cs.odu.edu/~mln/ltrs-pdfs/NASA-aiaa-2005-4448.pdf.

* cited by examiner

SYSTEMS AND METHODS FOR TRAFFIC PRIORITIZATION

TECHNICAL FIELD

The present disclosure generally relates to traffic prioritization, and more particularly relates to systems and methods for traffic prioritization for Visual Separation Approach.

BACKGROUND

Visual Separation Approach (VSA) is a procedure where the flight crew of an aircraft is required to follow a preceding aircraft visually and maintain a safe separation during approach as directed by the Air Traffic Controller. In one example, during the Visual Acquisition Phase, flight crew generally has to detect the preceding aircraft on a traffic display and out of the window of the aircraft, as commanded by the Air Traffic Controller.

In the vicinity of a busy airport, however, the traffic display can be cluttered with many traffic symbols, which may make detecting the preceding aircraft on the traffic display time consuming and difficult. In addition, the pilot may reduce a selected display range near the airport so that the pilot can view the airport map clearly. This may cause some of the traffic in the area to go out of the traffic display area on the traffic display, which can further complicate the detection of the preceding aircraft.

Accordingly, there is a need for traffic prioritization, which can improve the detection of a preceding aircraft during VSA.

BRIEF SUMMARY

An apparatus for traffic prioritization of surrounding air traffic for display onboard an aircraft is provided. The display can be associated with a user input that receives user input with respect to the display. The apparatus can include a traffic data source configured to supply surrounding traffic data. The surrounding traffic data including at least a range of the surrounding air traffic relative to the aircraft and a vertical speed of the surrounding air traffic. The apparatus can also include a traffic control module coupled to receive user selection data from the user input device and the surrounding traffic data from the traffic data source. The traffic control module, configured, upon receipt of the user input device and the surrounding traffic data, to generate a prioritization zone for prioritizing the surrounding air traffic to identify air traffic preceding the aircraft based on the user selection data, the range of the surrounding air traffic relative to the aircraft and the vertical speed of the surrounding air traffic, and set first traffic data that includes the surrounding air traffic within the prioritization zone listed by priority as a preceding aircraft and second traffic data that includes the surrounding air traffic outside of the prioritization zone listed in received sequence. The apparatus can include a graphical user interface manager control module coupled to the traffic control module and configured to output a graphical user interface, for display on the display, that includes the first traffic data and the second traffic data.

A method for traffic prioritization of surrounding air traffic relative to an ownship aircraft is provided. The method can include determining if the surrounding air traffic has a descending vertical speed, and prioritizing the surrounding air traffic with the descending vertical speed based on a bearing of the surrounding air traffic relative to the ownship aircraft. The method can include further prioritizing the surrounding air traffic based on a range of the surrounding air traffic from the ownship aircraft and outputting the prioritized surrounding air traffic.

Furthermore, other desirable features and characteristics of the systems and methods will become apparent from the subsequent detailed description and the appended claims, taken in conjunction with the accompanying drawings and the preceding background.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present teachings. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the present teachings and not to limit the scope of the present disclosure which is defined by the claims. Furthermore, there is no intention to be bound by any expressed or implied theory presented in the preceding technical field, background, brief summary, or the following detailed description.

Figure 1:
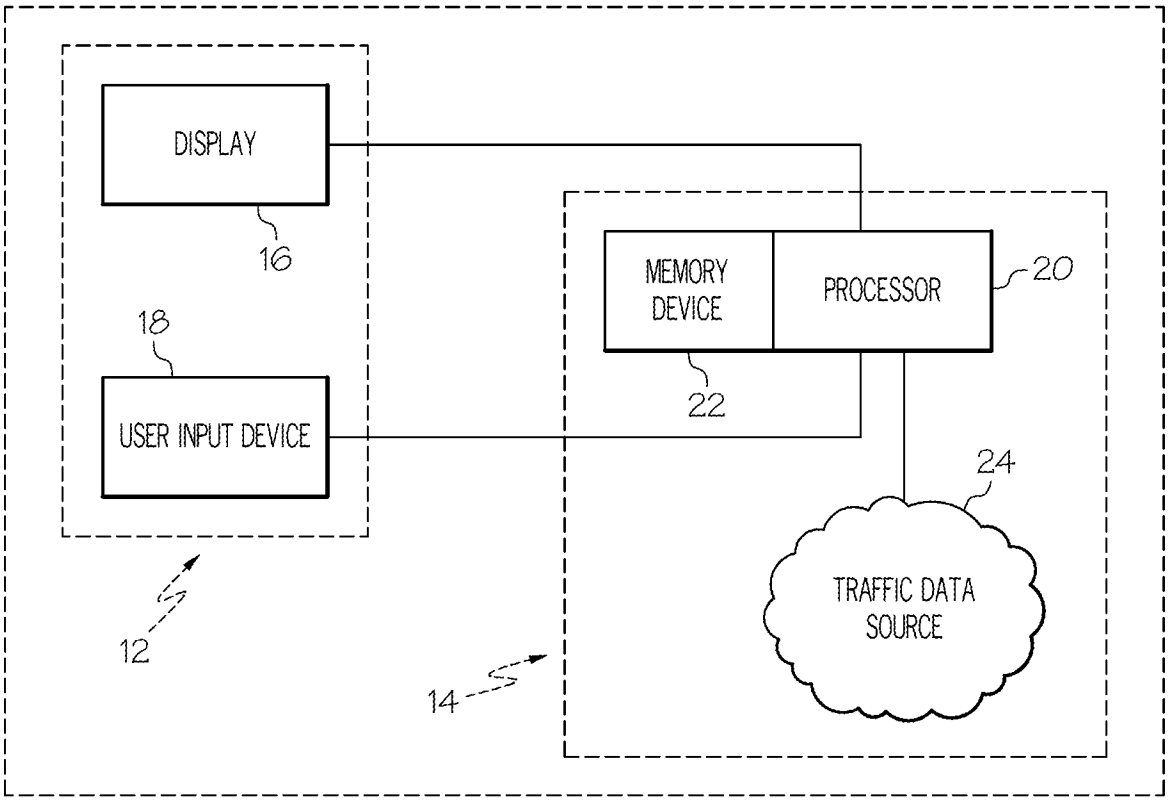
FIG. 1 is a functional block diagram illustrating an aircraft that includes a traffic prioritization system in accordance with an exemplary embodiment.

With reference to FIG. 1, a mobile platform, for example, but not limited to, an aircraft 10 is shown. The aircraft 10 can include a device 12. The device 12 can comprise any suitable electronic device that enables the display and manipulation of data, such as, but not limited to a handheld computing device, a tablet computing device, a stationary computing device, personal digital assistant, a portion of an electronic flight deck, etc. Further, it should be noted that although a single device 12 is shown, the aircraft 10 could include multiple devices 12. The device 12 can be in communication with a traffic prioritization system 14 through any suitable wired or wireless link. As will be discussed herein, the traffic prioritization system 14 can enable the display of traffic prioritized to assist in a VSA maneuver. It should be noted that although the traffic prioritization system 14 is described and illustrated herein as being used with the device 12 on an aircraft 10, the traffic prioritization system 14 could also be employed with ground based devices, such as ground based transit systems. Generally, the device 12 can be positioned adjacent and for use by a pilot or co-pilot of the aircraft 10, however, another device 12 could be provided in the cockpit for use by the other of the pilot and the co-pilot. With continued reference to FIG. 1, the device 12 can include a display 16 and a user input device 18.

The display 16 can display various images and data, in both a graphical and textual format. In one example, the display 16 can each display one or more graphical user interfaces (GUIs) generated by the traffic prioritization system 14. The display 16 can comprise any suitable technology for displaying information, including, but not limited to, a liquid crystal display (LCD), organic light emitting diode (OLED), plasma, or a cathode ray tube (CRT). The display 16 can be in communication with the traffic prioritization system 14 for receiving data from the traffic prioritization system 14. Those skilled in the art realize numerous techniques to facilitate communication between the display 16 and the traffic prioritization system 14. Further, it should be noted that although one display 16 is illustrated, the device 12 could include multiple displays or could be in communication with multiple displays as known in the art.

The user input device 18 can receive data and/or commands from the operator of the device 12. The user input device 18 can be in communication with the traffic prioritization system 14 such that the data and/or commands input by the operator to the device 12 can be received by the traffic prioritization system 14. Those skilled in the art realize numerous techniques to facilitate communication between the user input device 18 and the traffic prioritization system 14. The user input device 18 can be implemented with any suitable technology, including, but not limited to, a touchscreen interface (e.g., overlaying the display 16), a touch pen, a keyboard, a number pad, a mouse, a touchpad, a roller ball, a pushbutton, a switch, speech recognition technology, voice commands, etc.

The traffic prioritization system 14 can include a processor 20 for generating one or more GUIs that allow the display of prioritized traffic for a VSA maneuver, and a memory device 22 for storing data. In one embodiment, the entire traffic prioritization system 14 can be disposed aboard the aircraft 10 for assisting in operations of the aircraft 10. However, in other embodiments, all or part of the traffic prioritization system 14 may be disposed apart from the aircraft 10. The processor 20 of the illustrated embodiment is capable of executing one or more programs (i.e., running software) to perform various tasks instructions encoded in the program(s). The processor 20 may be a microprocessor, microcontroller, application specific integrated circuit (ASIC) or other suitable device as realized by those skilled in the art. Of course, the traffic prioritization system 14 may include multiple processors 20, working together or separately, as is also realized by those skilled in the art.

The memory device 22 is capable of storing data. The memory device 22 may be random access memory (RAM), read-only memory (ROM), flash memory, a memory disk (e.g., a floppy disk, a hard disk, or an optical disk), or other suitable device as realized by those skilled in the art. In the illustrated embodiments, the memory device 22 is in communication with the processor 20 and stores the program(s) executed by the processor 20. Those skilled in the art realize that the memory device 22 may be an integral part of the processor 20. Furthermore, those skilled in the art realize that the traffic prioritization system 14 may include multiple memory devices 22.

The traffic prioritization system 14 can receive data from a traffic data source 24. The traffic data source 24 can be in communication with the processor 20 for providing the processor 20 with data for generating one or more of the GUIs. The traffic data source 24 can comprise any suitable source of surrounding traffic data and flight data related to the operation of the aircraft 10, including, but not limited to, systems onboard or external to the aircraft 10. For example, the surrounding traffic data can be provided by the Air Traffic Controller, Traffic Collision Avoidance System (TACS), Automatic Dependent Surveillance-Broadcast (ADS-B), Traffic Information Services-Broadcast (TIS-B) and/or Automatic Dependent Surveillance-Re-broadcast (ADS-R). In one example, the traffic data source 24 can provide the processor 20 with data relating to air speed of surrounding aircraft, orientation of the surrounding aircraft, location of the surrounding aircraft, altitude of the surrounding aircraft, which can all be measured relative to the aircraft 10.

The traffic prioritization system 14 can enable the prioritization of traffic during a VSA maneuver for display on the display 16 and can also provide an indicator that identified traffic is off an area defined for display on the display 16. In this regard, as will be discussed, when active, the traffic prioritization system 14 can prioritize traffic so that one or more preceding aircraft are easily identifiable on the display 16, and can also indicate when surrounding air traffic is not shown on the display 16. This can enable the pilot to easy determine the preceding aircraft from the display 16 during a VSA maneuver.

Figure 2:
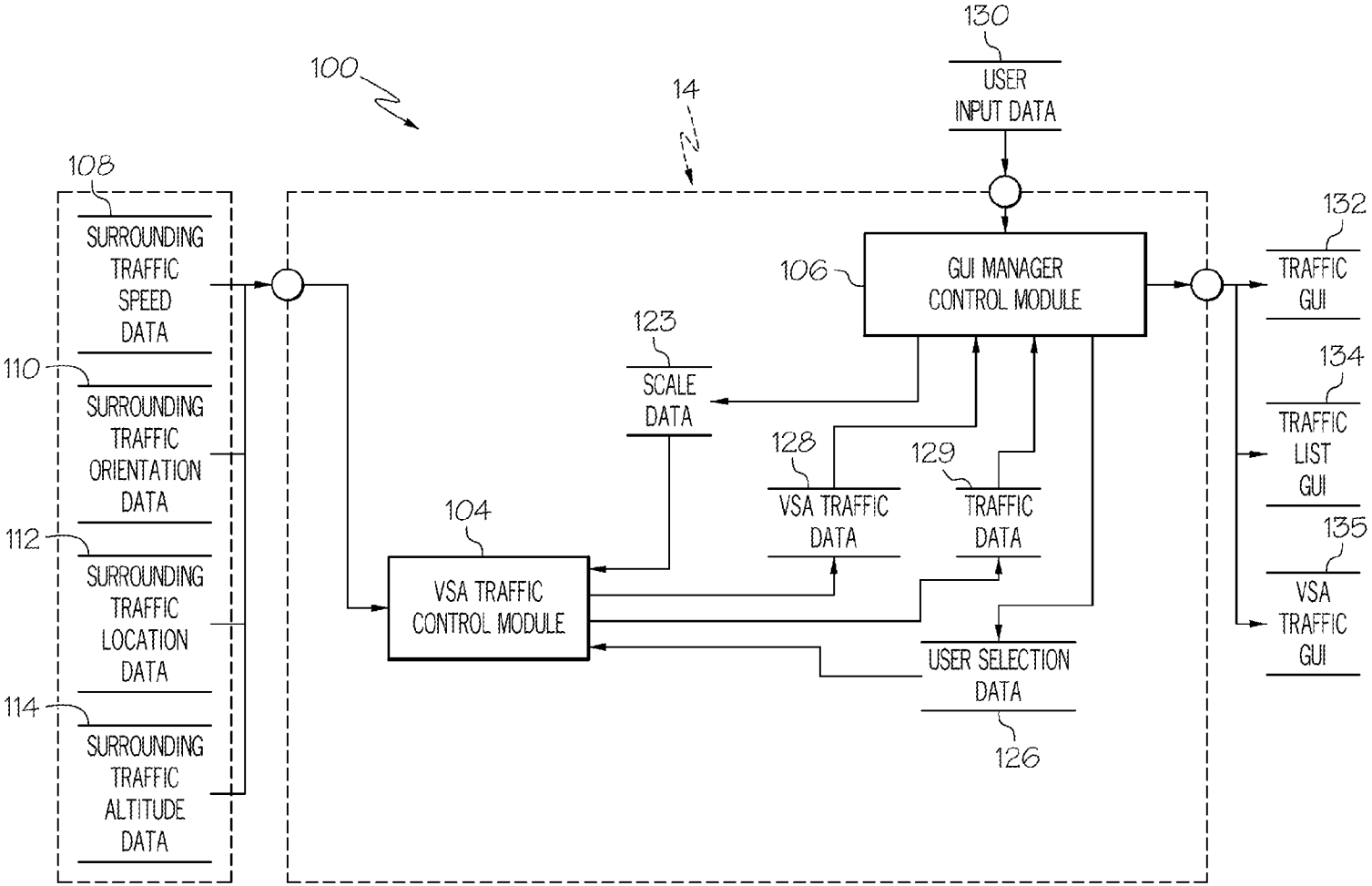
FIG. 2 is a dataflow diagram illustrating a control system of the traffic prioritization system in accordance with an exemplary embodiment.

Referring now to FIG. 2, a dataflow diagram illustrates various embodiments of the traffic prioritization system 14 that may be embedded within a control module 100 and performed by the processor 20 (FIG. 1). Various embodiments of the traffic prioritization system 14 according to the present disclosure can include any number of sub-modules embedded within the control module 100. As can be appreciated, the sub-modules shown in FIG. 2 can be combined and/or further partitioned to determine the display output by the display 16 (FIG. 1). Inputs to the system may be sensed from the aircraft 10 (FIG. 1), received from other control modules (not shown), and/or determined/modeled by other sub-modules (not shown) within the control module 100. In various embodiments, the control module 100 can include a VSA traffic control module 104 and a GUI manager control module 106.

The VSA traffic control module 104 can receive as input surrounding traffic speed data 108, surrounding traffic orientation data 110, surrounding traffic location data 112 and surrounding traffic altitude data 114. The VSA traffic control module 104 can also receive as input scale data 123 and user selection data 126. The surrounding traffic speed data 108 can comprise the vertical speed of each surrounding aircraft, and can also indicate if the vertical speed is ascending or descending. The surrounding traffic orientation data 110 can comprise data regarding the orientation, bearing or angle of the surrounding aircraft in flight relative to the aircraft 10. The surrounding traffic location data 112 can comprise data regarding the distance or range of the surrounding aircraft from the aircraft 10. The surrounding traffic altitude data 114 can comprise the altitude of the surrounding aircraft relative to the aircraft 10. The scale data 123 can indicate a scale for the display of the surrounding air traffic on the display 16. In one example, the user selection data 126 can comprise a selection of a VSA traffic prioritization method for display on the display 16, as will be discussed in greater detail herein.

Based on the surrounding traffic speed data 108, surrounding traffic orientation data 110, surrounding traffic location data 112, surrounding traffic altitude data 114, scale data 123 and user selection data 126, the VSA traffic control module 104 can set first traffic data or VSA traffic data 128 for the GUI manager control module 106 and second traffic data or traffic data 129 for the GUI manager control module 106. The VSA traffic data 128 can comprise traffic prioritized for use during a VSA maneuver. For example, the VSA traffic data 128 can comprise a ranking of the surrounding air traffic based on the suitability for the aircraft to be a preceding aircraft in the VSA maneuver. The VSA traffic data 128 can also include an indication if the listed traffic is outside the scale set for the display of the surrounding air traffic on the display 16. The traffic data 129 can comprise traffic outside of a prioritization zone identified by the VSA traffic control module 104 for prioritization based on the user input data 130, which can be listed in received sequence. The traffic data 129 can also include an indication if the listed traffic is outside the scale set for the display of the surrounding air traffic on the display 16.

The GUI manager control module 106 can receive as input user input data 130, the VSA traffic data 128 and the traffic data 129. The user input data 130 can comprise input received from the user input device 18. The user input data 130 can include data regarding a selection to use the VSA prioritization method and can comprise a selected orientation or bearing value for the surrounding air traffic relative to the centerline of the aircraft 10, a selected range value for the surrounding air traffic relative to the aircraft 10 and a selected altitude value for the surrounding air traffic relative to the aircraft 10. The user input data 130 can also comprise data regarding a selected scale for the display of the surrounding air traffic. Based on the user input data 130, the VSA traffic data 128 and the traffic data 129, the GUI manager control module 106 can output a traffic GUI 132, a traffic list GUI 134 and a VSA traffic GUI 135. In one example, the traffic GUI 132, the traffic list GUI 134 and the VSA traffic GUI 135 can be output for display on the display 16, however, the traffic GUI 132, traffic list GUI 134 and VSA traffic GUI 135 can be displayed on different displays 16 associated with the device 12 or with other devices within the aircraft 10. Further, one or more of the traffic list GUI 134 and VSA traffic GUI 135 could be superimposed on at least a portion of the traffic GUI 132.

Figure 3:
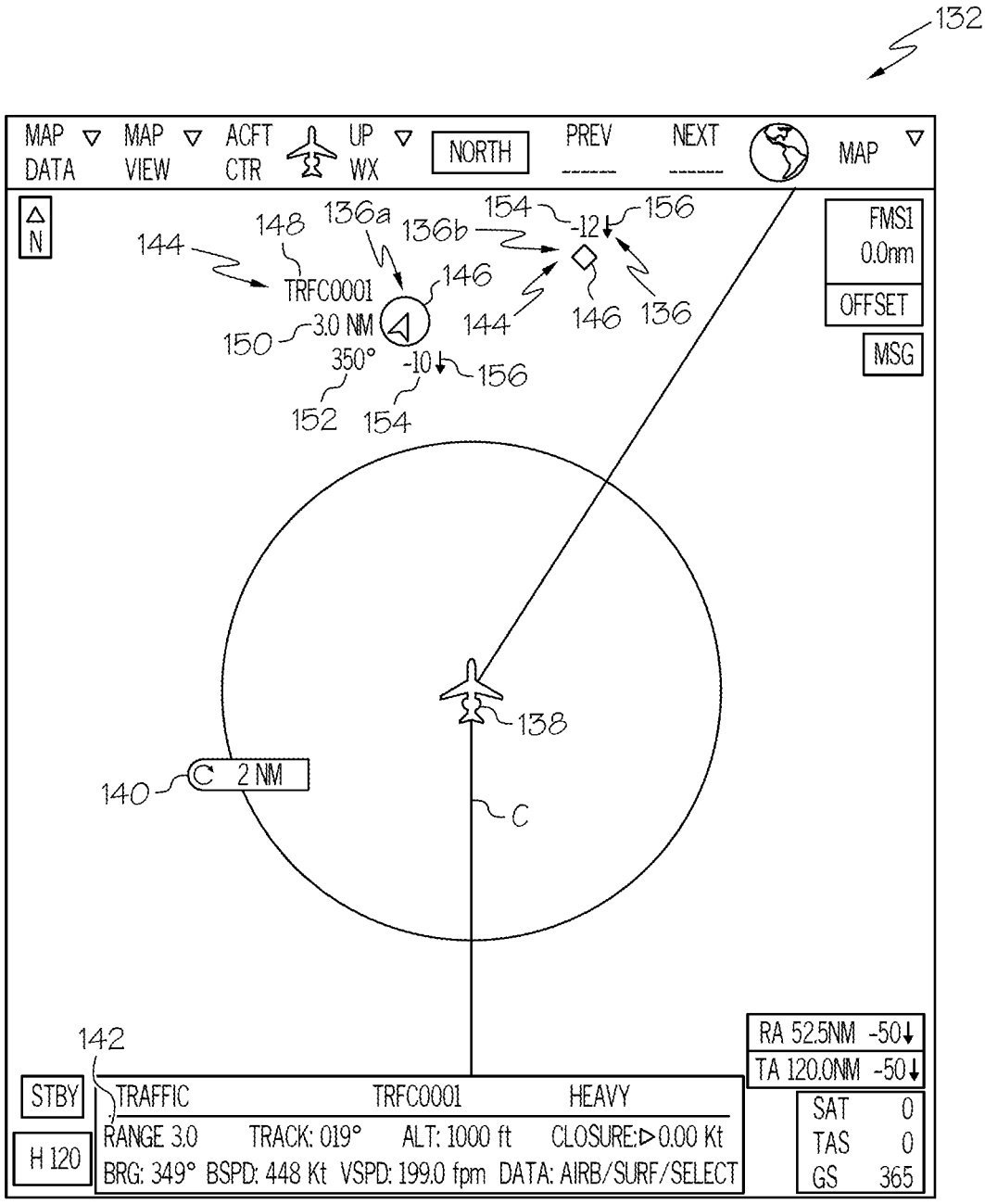
FIG. 3 is an exemplary traffic graphical user interface in accordance with an exemplary embodiment.

With reference to FIG. 3, an exemplary traffic GUI 132 is illustrated. The traffic GUI 132 can display various data regarding traffic surrounding the aircraft 10. In one example, the traffic GUI 132 can display one or more traffic icons 136, an icon 138 of the aircraft 10, a scale 140 and a range 142. The traffic icons 136*a*, 136*b* can provide a graphical representation of the air traffic surrounding the aircraft 10. One or more of the traffic icons 136 can include text data 144 along with a graphical symbol 146. In one example, the text data 144 of the traffic icon 136*a* can include a flight ID 148, a distance 150 from the aircraft 10 from the surrounding traffic location data 112, an orientation or bearing 152 of the air traffic relative to a centerline of the aircraft 10 from the surrounding traffic orientation data 110 and an altitude 154 of the air traffic from the surrounding traffic altitude data 114. An indicator 156 of the direction of the vertical speed of the air traffic can be adjacent to the altitude 154, which can be based on the surrounding traffic speed data 108. It should be noted that the text data 144 and graphical symbol 146 are merely exemplary, as the data could be display in any suitable manner. Furthermore, each traffic icon 136 can include any amount of text data 144, as illustrated with regard to traffic icon 136*b*.

The icon 138 of the aircraft 10 can also include an indicator of a centerline C of the aircraft 10. The scale 140 can provide a visual indicator as to the scale of the traffic GUI 132 relative to the aircraft 10 and can comprise the scale data 123. The scale 140 can be adjustable through a scroll icon 140*a* via the user input device 18. In the example illustrated, the scale 140 is set at 2 nautical miles, but this is merely exemplary. The range 142 can provide an outer boundary for the data displayed in the traffic GUI 132, and can be presented in a table with additional data regarding the flight plan of the aircraft 10. In the illustrated example, the range 142 can be three nautical miles, but this is merely exemplary. The traffic GUI 132 can be used with the VSA traffic GUI 135 to enable the pilot to identify a preceding aircraft.

Figure 4:
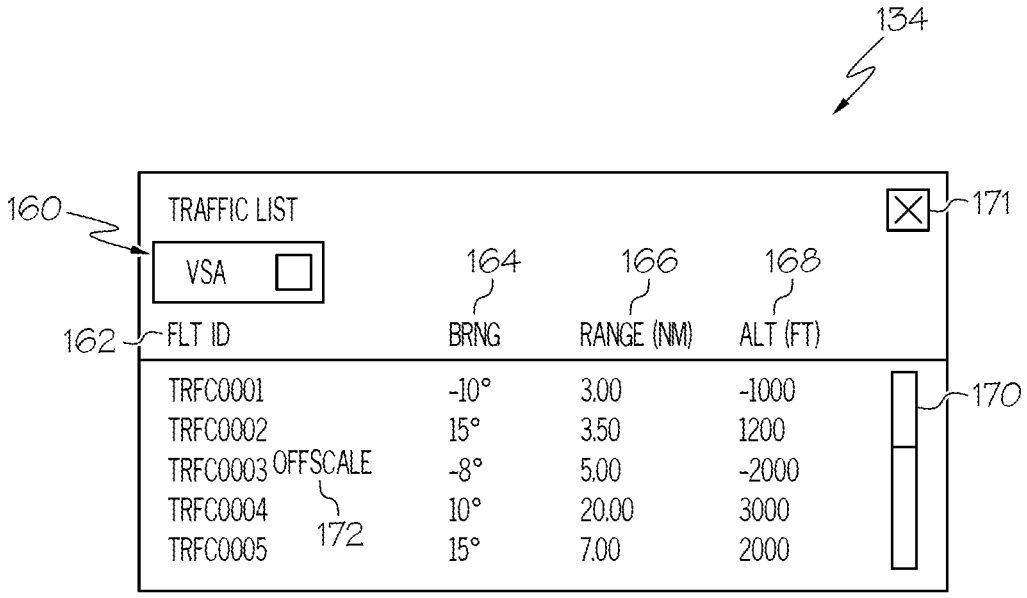
FIG. 4 is an exemplary traffic list graphical user interface in accordance with an exemplary embodiment.

With reference to FIG. 4, an exemplary traffic list GUI 134 is illustrated. In this example, the VSA prioritization method has not been activated via user input to the user input device 18. The traffic list GUI 134 can include a VSA activation selector 160, a flight ID list 162, a bearing list 164, a range list 166, an altitude list 168 and a scroll bar 170. The traffic list GUI 134 can also include a close indicator 171 to enable the user to end the display of the traffic list GUI 134. In one example, the flight ID list 162, bearing list 164, range list 166 and altitude list 168 are presented in tabular form, however, any suitable display method could be employed. The VSA activation selector 160 can comprise a checkbox, which can be checked by the user via the user input device 18 to enable prioritization of at least a portion of the listed surrounding air traffic by a VSA prioritization method. The flight ID list 162 can list flight identification (ID) numbers associated with each surrounding aircraft or identifying information for each of the surrounding air traffic. In this example, as the VSA activation selector 160 is unchecked, the flight ID list 162 can be listed sequentially based on the traffic data 129. The bearing list 164 can comprise the surrounding traffic orientation data 110 for each listed flight ID relative to the aircraft 10. The range list 166 can comprise the surrounding traffic location data 112 for each listed flight ID in nautical miles. The altitude list 168 can comprise the surrounding traffic altitude data 114 for each listed flight ID in feet. The scroll bar 170 can enable the user to scroll through the listed air traffic.

In addition, the traffic list GUI 134 can include at least one offscale indicator 172. In this example, the offscale indicator 172 can comprise a textual indicator that a particular flight ID associated with a surrounding aircraft is outside the scale 140 of the traffic GUI 132 (FIG. 3), and thus, is not visible on the display 16. It should be noted that the use of the text "OFF-SCALE" as a textual indicator is merely exemplary, as any suitable textual indicator could be employed to display that a neighboring aircraft is outside of the scale 140 of the traffic GUI 132 (FIG. 3). Alternatively, with reference to FIG. 5, an offscale indicator 174 can comprise a graphical indicator. In this example, the offscale indicator 174 can comprise a half chevron 176. If the neighboring aircraft is completely within the scale 140 of the traffic GUI 132 (FIG. 3), then an half chevron 176*a* can be completely opaque. If the neighboring aircraft is outside of the scale 140 of the traffic GUI 132 (FIG. 3), then an arrow 176*b* can be partially opaque. It should be noted that the use of an half chevron as a graphical indicator is merely exemplary, as any suitable graphical indicator could be employed to display that a neighboring aircraft is outside of the scale 140 of the traffic GUI 132 (FIG. 3).

Figure 5:
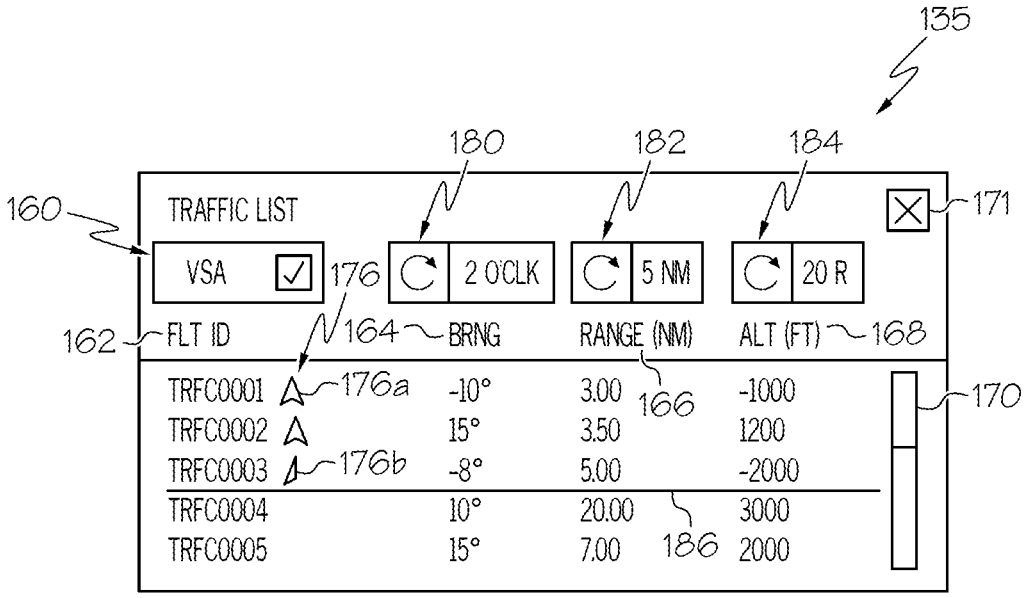
FIG. 5 is an exemplary Visual Separation Approach (VSA) traffic graphical user interface in accordance with an exemplary embodiment.

With continued reference to FIG. 5, the VSA traffic GUI 135 is illustrated. In this example, the VSA prioritization method has been activated via user input to the user input device 18. The VSA traffic GUI 135 can include the VSA activation selector 160, the flight ID list 162, the bearing list 164, the range list 166, the altitude list 168 and the scroll bar 170. The VSA traffic GUI 135 can also include an orientation or bearing filter selector 180, a range filter selector 182, an altitude filter selector 184 and a separation indicator 186.

Figure 5A:
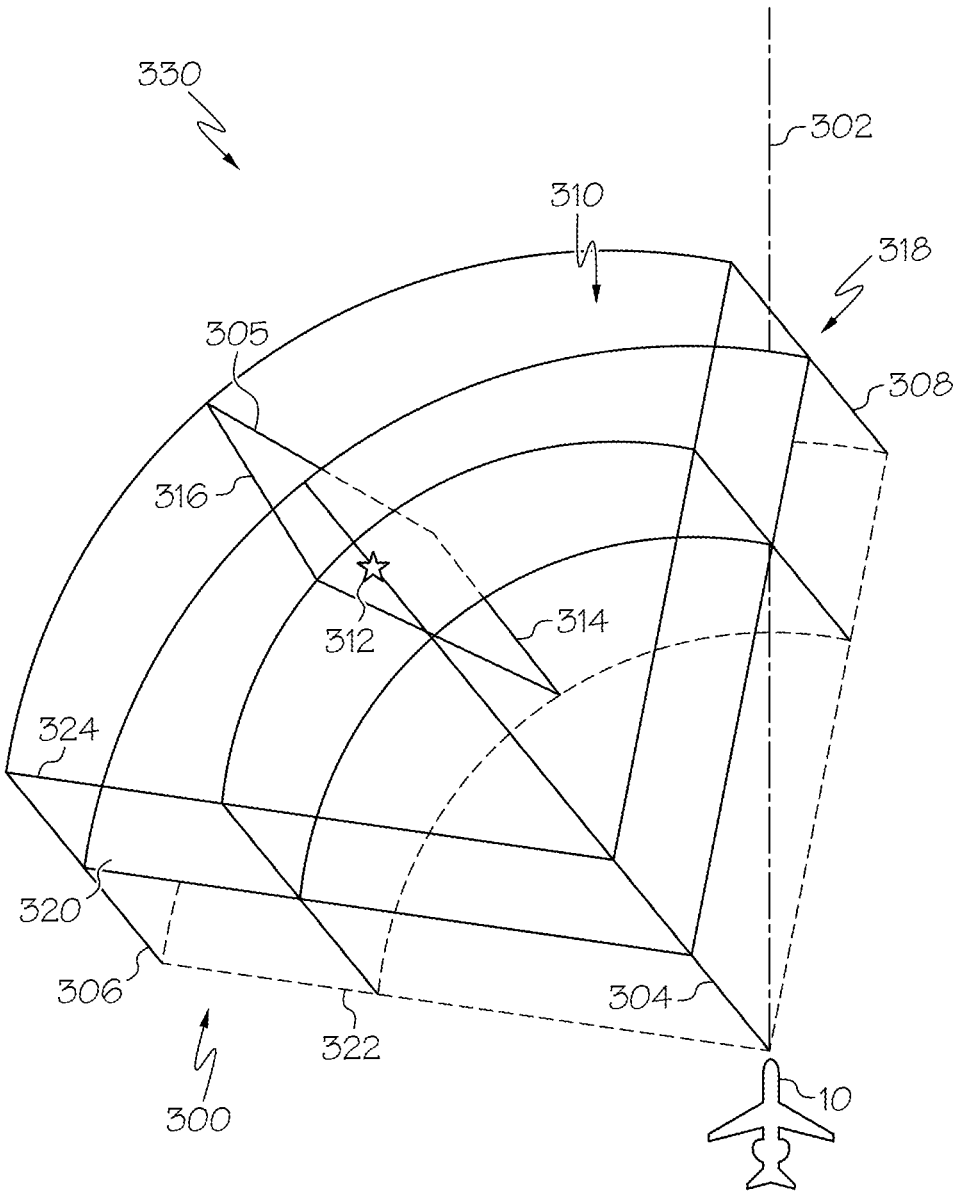
FIG. 5A is an exemplary schematic illustration of a VSA prioritization zone defined using the VSA traffic graphical user interface of FIG. 5.

The bearing filter selector 180 can enable the user via the user input device 18 to select a bearing value to define a horizontal zone where the probability of finding a preceding aircraft is high. In one example, the bearing value can be selected up to about 11 o'clock, which defines a horizontal zone from about negative 30 degrees to about positive 30 degrees relative to 11 o'clock. Generally, when the VSA prioritization method is initially activated, the default bearing value can be two o'clock. As an example, with reference to FIG. 5A, a horizontal zone 300 defined by the bearing filter selector 180 is shown. Generally, the horizontal zone 300 can be defined relative to a reference line 304 and a reference point 312. The reference point 312 can be established based on the values of the bearing filter selector 180, range filter selector 182 and altitude filter selector 184. For example, if the bearing filter selector 180 is set at 2 o'clock, the range filter selector 182 is set at 5 nautical miles and the altitude filter selector 184 is set at 2000 feet, then the reference point 312 can be located at a point in airspace that is located at 2 o'clock relative to the aircraft 10, 5 nautical miles from the aircraft 10 and at 2000 feet relative to the altitude of the aircraft 10. The reference line 304 can extend from the aircraft 10 to the reference point 312. In this example, the bearing value can be about 2 o'clock from a track line 302 of the aircraft 10, which can be represented by a vertical reference plane 305. The vertical reference plane 305 can be defined through a portion of the reference line 304 on either side of the reference point 312. The horizontal zone 300 can range from about negative 30 degrees as illustrated by boundary 306 to about positive 30 degrees as illustrated by boundary 308. The traffic can be prioritized based on proximity to the vertical reference plane 305 within the horizontal zone 300. Thus, traffic closer to the vertical reference plane 305 can be ranked higher than traffic closer to the boundary 306, 308.

With reference back to FIG. 5, the range filter selector 182 can enable the user via the user input device 18 to select a range value to define a horizontal zone where the probability of finding preceding aircraft is high. In one example, the range value of the range filter selector 182 can be selected from about 5 nautical miles relative to the aircraft 10 to define a horizontal zone from about 3 nautical miles on either side of the reference point 312. Generally, when the VSA prioritization method is initially activated, the default range value can be about five nautical miles. As an example, with reference to FIG. 5A, a horizontal zone 310 defined by the range filter selector 182 is shown. In this example, the range value can be about 5 nautical miles relative to the bearing value selected by the bearing filter selector 180, and can be represented by the reference point 312. The horizontal zone 310 can range from about 3 nautical miles relative to the reference point 312 towards aircraft 10 as illustrated by boundary 314 to about 3 nautical miles relative to reference point 312 away from aircraft 10 as illustrated by boundary 316. Thus, traffic closer to the reference point 312 can be ranked higher than traffic closer to the boundary 314, 316.

With reference back to FIG. 5, the altitude filter selector 184 can enable the user via the user input device 18 to select an altitude value to define a vertical zone where the probability of finding a preceding aircraft is high. In one example, the altitude value can be selected at about 2000 feet, which can define a vertical zone from about negative 2000 feet to about positive 2000 feet relative to the user selected altitude in the altitude filter selector 184. Generally, when the VSA prioritization method is initially activated, the default altitude value can be 2000 feet. As an example, with reference to FIG. 5A, a vertical zone 318 defined by the altitude filter selector 184 is shown. In this example, the altitude value can be about 2000 feet relative to the bearing value selected by the bearing filter selector 180 and the range value selected by the range filter selector 182, and can be represented by a horizontal reference plane 320. The horizontal reference plane 320 can be defined so as to include a portion of the reference line 304 on either side of the reference point 312. The vertical zone 318 can range from about negative 2000 feet as illustrated by boundary 322 to about positive 2000 feet as illustrated by boundary 324. Traffic closer to the horizontal reference plane 320 can be ranked higher than traffic closer to the boundary 324, 322. Thus, the VSA traffic control module 104 can generate a prioritization zone 330 or zone of probable preceding aircraft relative to the aircraft 10 based on the values of the bearing filter selector 180, range filter selector 182 and altitude filter selector 184 input through the user input device 18. The traffic within the prioritization zone 330 can then be prioritized using the VSA traffic prioritization method, as will be discussed further herein.

With reference back to FIG. 5, the separation indicator 186 can indicate which of the surrounding aircraft listed in the flight ID list 162 have been prioritized based on the VSA prioritization method. In one example, the surrounding aircraft listed above the separation indicator 186, between the VSA activation selector 160 and the separation indicator 186, comprise VSA traffic data 128, and the surrounding aircraft listed below the separation indicator 186 comprise traffic data 129 or traffic not within the zone of probable preceding aircraft defined by the VSA traffic control module 104 using the user input data 130. It should be noted that the use of a line for the separation indicator 186 is merely exemplary as any suitable textual or graphical indicator could be employed to distinguish the traffic prioritized using the VSA prioritization method.

Figure 6:
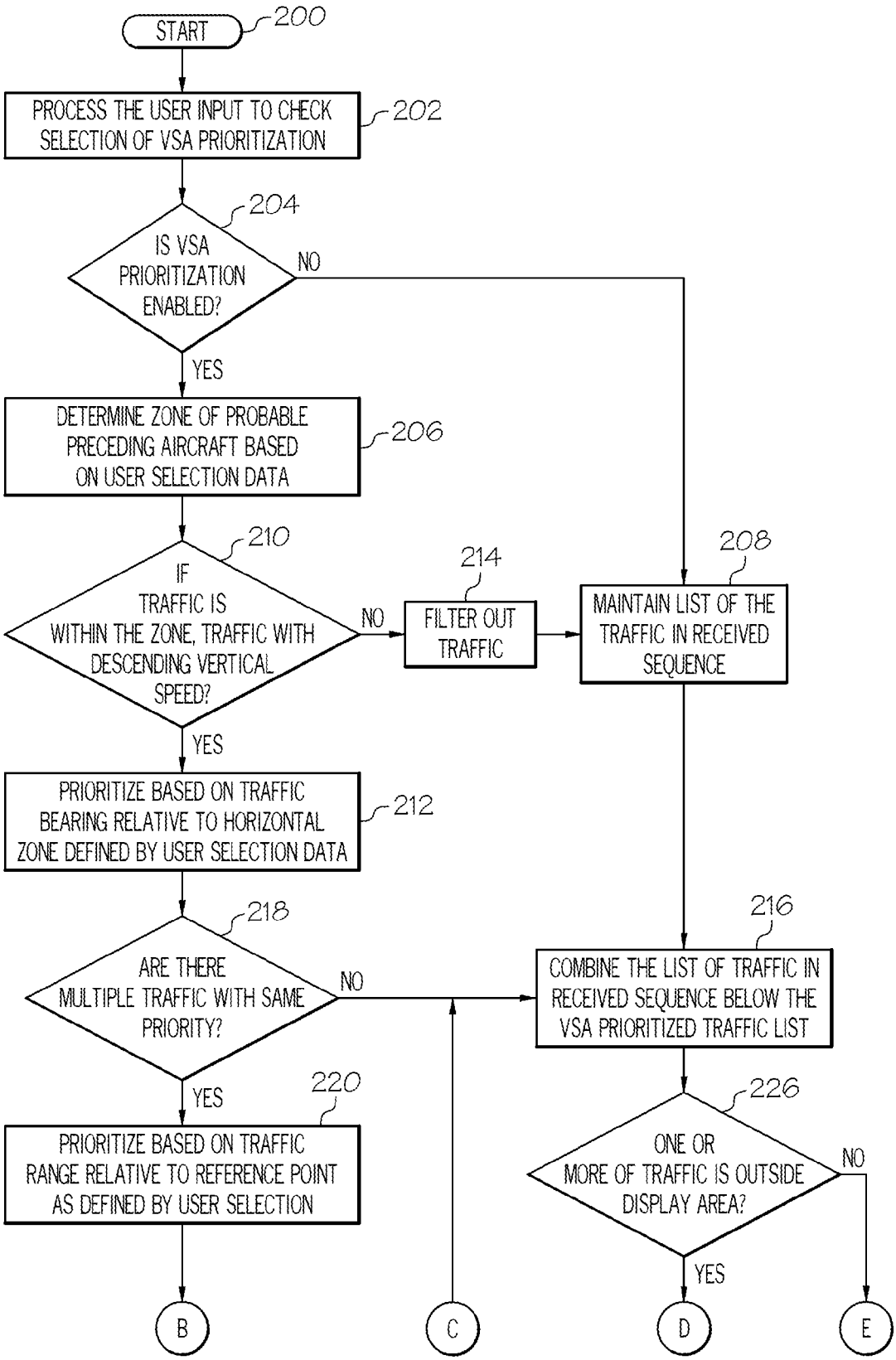
FIG. 6 is a flowchart illustrating a control method of the traffic prioritization system in accordance with an exemplary embodiment.
Figure 7:
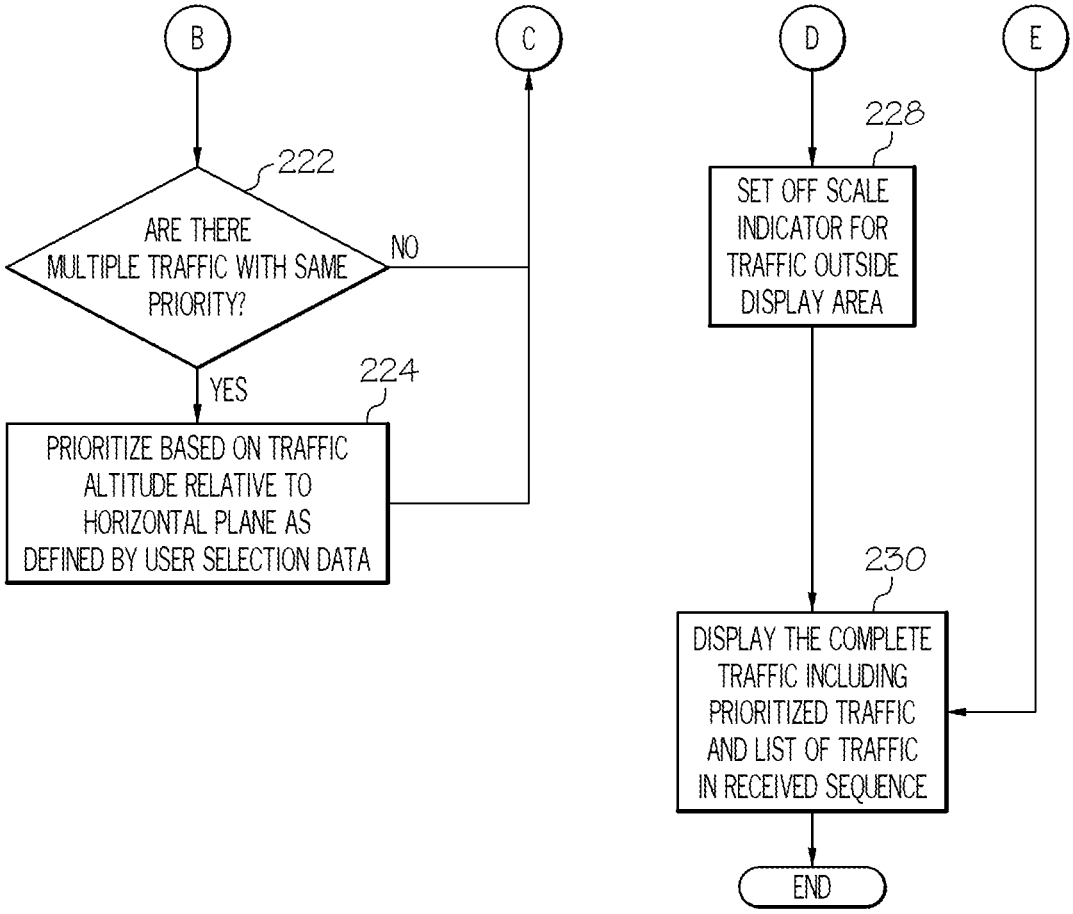
FIG. 7 is a continuation of the flowchart of FIG. 6.

Referring now to FIGS. 6 and 7, and with continued reference to FIGS. 1-5, a flowchart illustrates a control method or VSA prioritization method that can be performed by the control module 100 of FIG. 2 in accordance with the present disclosure. As can be appreciated in light of the disclosure, the order of operation within the method is not limited to the sequential execution as illustrated in FIGS. 6 and 7, but may be performed in one or more varying orders as applicable and in accordance with the present disclosure.

In various embodiments, the method can be scheduled to run based on user selection of the VSA activation selector 160, but the method can run based on other predetermined events, such as the descent into an airport.

The method can begin at 200. At 202, the method can determine if the VSA activation selector 160 has been selected. If the VSA prioritization method has been selected at 204, then the method can go to 206. Otherwise, the method can go to 208. At 206, the method can determine the prioritization zone of probable preceding aircraft traffic based on the user input to the bearing filter selector 180, range filter selector 182 and altitude filter selector 184 or the default values for the bearing, range and altitude. Thus, 206 can act as an initial filter to determine of all the aircraft in the area, which meet default criteria for prioritization as a potential preceding aircraft during a VSA maneuver. At 210, the method can determine which of the traffic within the prioritization zone has a descending vertical speed. If one or more of the surrounding aircraft has a descending vertical speed, the method can go to 212. Otherwise, the method can go to 214. At 214, the method can filter out the traffic that does not have a descending vertical speed, and at 208, the method can maintain a list of the traffic received in sequence, thereby generating traffic data 129. Then, the method can go to 216.

Figure 6A:
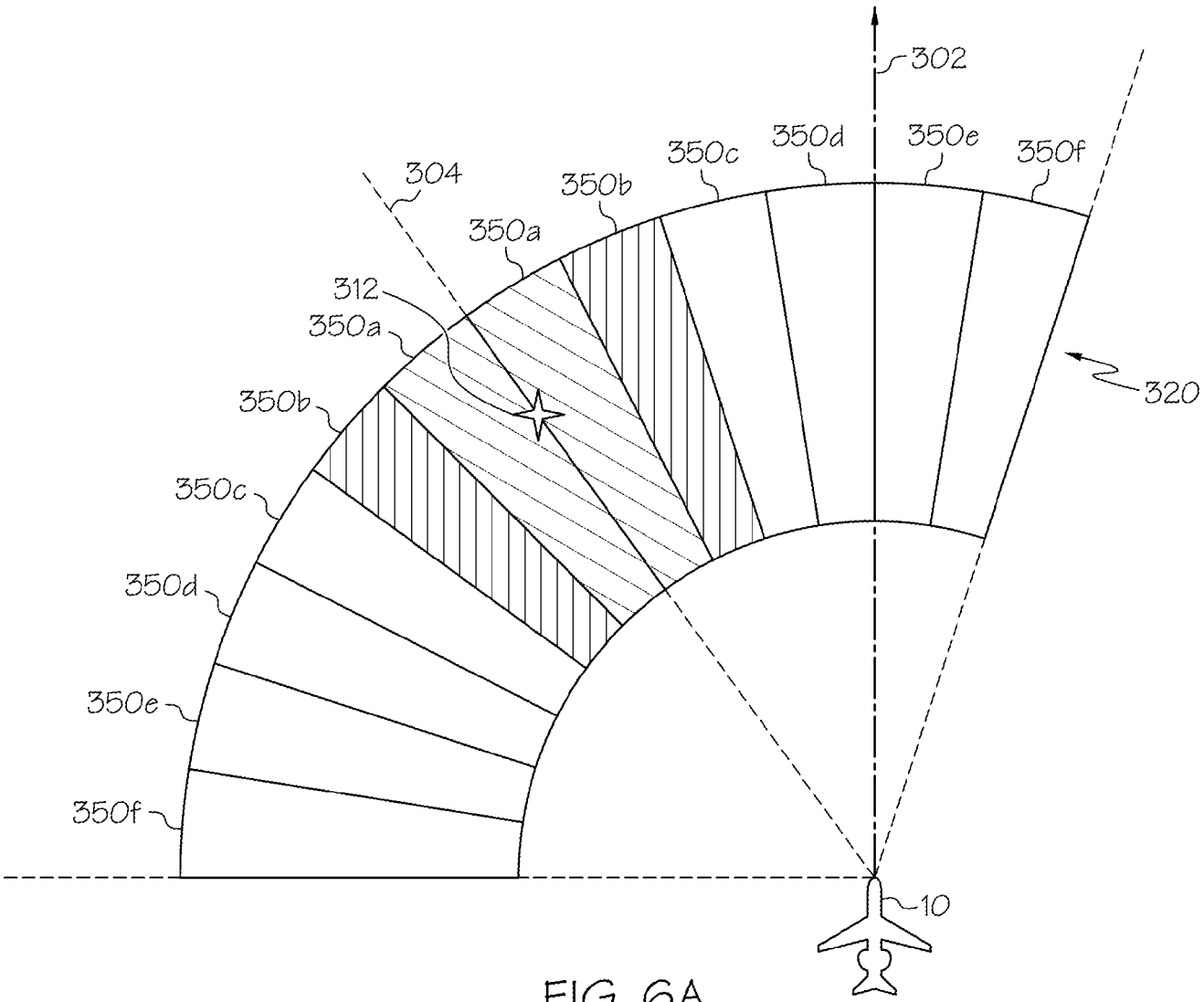
FIG. 6A is an exemplary schematic illustration of a prioritization zone defined based on a bearing value.

At 212, the method can prioritize the surrounding air traffic using the surrounding traffic orientation data 110 and the bearing value set by user input to the bearing filter selector 180 or the default bearing value. Generally, with reference to FIG. 5A, the method can prioritize the surrounding air traffic with the traffic having a bearing closest to the vertical reference plane 305 being ranked higher than surrounding aircraft having a bearing closer to the boundary 306, 308. In one example, with reference to FIG. 6A, the horizontal zone 300 defined by the bearing filter selector 180 can be divided into about 5 degree segments 350*a-f* on each side of the reference line 304. All traffic within a respective one of the segments 350*a-f* can be assigned the same priority. For example, if two aircraft are within segment 350*a*, they will each be assigned the same priority, and this priority will be ranked higher than aircraft within segment 350*b*.

Figure 6B:
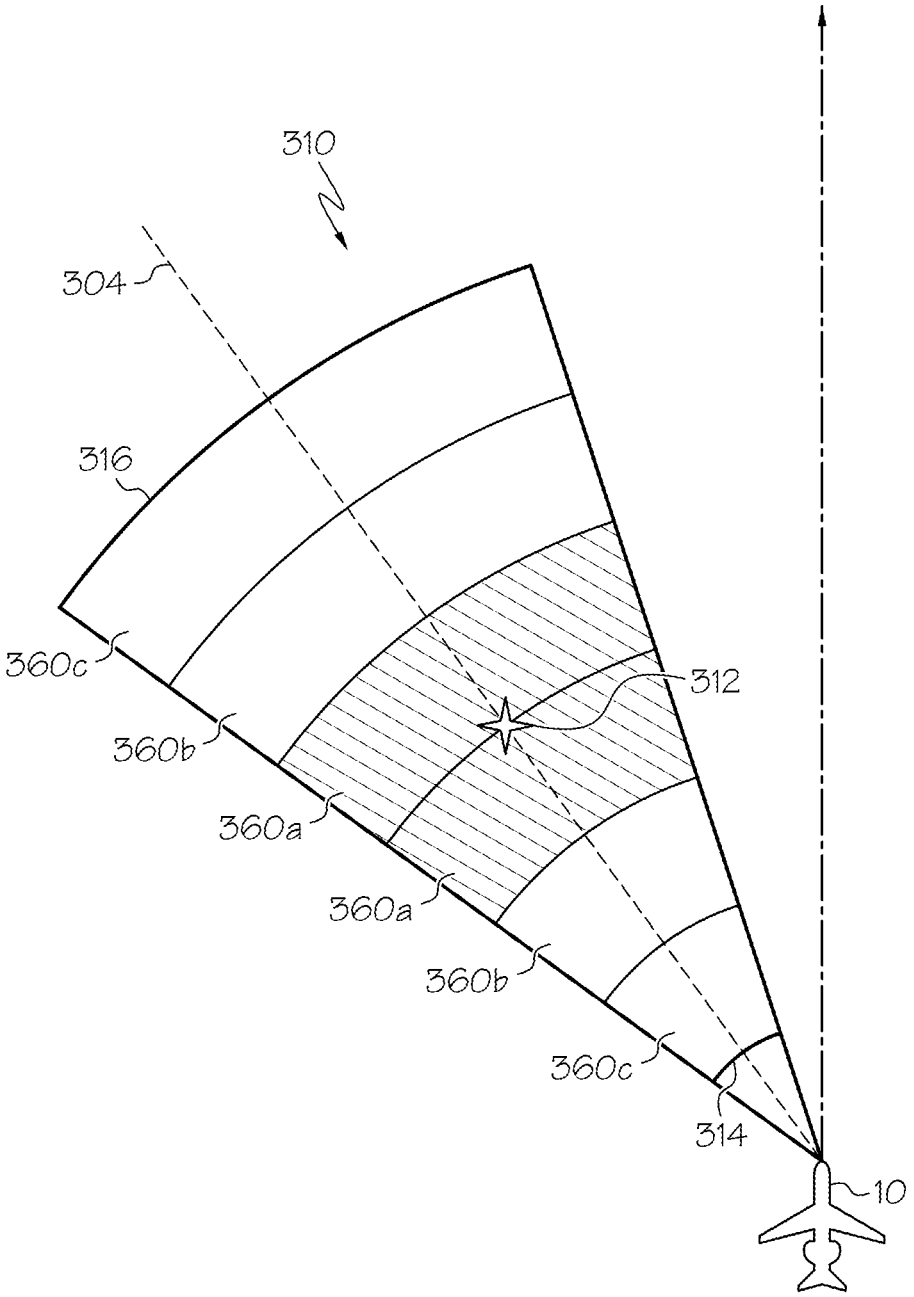
FIG. 6B is an exemplary schematic illustration of a prioritization zone defined based on a range value.

With reference back to FIG. 6, at 218, the method can determine if multiple traffic have the same priority. If the identified traffic all have a unique priority, then the method can go to 216. Otherwise, at 220, the method can further prioritize the surrounding aircraft based on the surrounding traffic location data 112 and the range value set by user input to the range filter selector 182 or the default range value. In one example, with reference to FIG. 5A, surrounding aircraft closest to the reference point 312 is ranked higher than surrounding aircraft located closer to the boundary 314, 316. In one exemplary embodiment, with reference to FIG. 6B, the horizontal zone 310 defined by the user input to the range filter selector 182 can be divided into segments 360*a-c* on either side of the reference point 312. In this example, the horizontal zone 310 can be divided into segments 360*a-c* of about 1 nautical mile, with traffic within each segment being assigned the same priority. It should be noted that the segments 360*a-c* can have any desired size, such as 0.5 nautical miles. If there are two aircraft within segment 360*b*, then each of these aircraft will be assigned the same priority, which will be lower than the priority assigned to aircraft within segment 360*a*. Then, the method goes to 222 on FIG. 7.

With reference to FIG. 7, at 222, the method can determine if multiple traffic have the same priority. If the traffic all have a unique priority, then the method can go to 216. Otherwise, at 224, the method can further prioritize the surrounding traffic based on the surrounding traffic altitude data 114 and the user input to the altitude filter selector 184 or the default altitude filter data. In one example, with reference to FIG. 5A, surrounding aircraft with an altitude closest to the plane 320 defined by the user input to the altitude filter selector 184 or default altitude data can be ranked higher than surrounding aircraft with an altitude closer to the boundary 322, 324. In this example, if traffic has the same altitude relative to the plane 320, then traffic located above the plane 320 can be ranked lower than traffic located below the plane 320. Then, the method can go to 216 on FIG. 6.

At 216, the method can combine the traffic data 129 with the VSA traffic data 128. Then, at 226, the method can determine if one or more of the surrounding traffic is outside of the scale 140 of the traffic GUI 132 (FIG. 3). If one or more of the surrounding traffic is outside the traffic GUI 132 based on the scale 140 of the traffic GUI 132, then the method goes to 228 on FIG. 7. Otherwise, the method goes to 230 on FIG. 7.

With reference to FIG. 7, at 228, the method sets an offscale indicator 172, 174 for the selected traffic outside of the scale 140 of the traffic GUI 132. At 230, the method displays the traffic as VSA traffic data 128 and traffic data 129 on the VSA traffic GUI 135, with the traffic data 129 displayed below the separation indicator 186 (FIG. 5). Then, the method can end.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal In the alternative, the processor and the storage medium may reside as discrete components in a user terminal In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the present disclosure as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It being understood that various changes may be made in the function and arrangement of elements described in an exemplary embodiment without departing from the scope of the present disclosure as set forth in the appended claims.

What is claimed is:

1. A system for traffic prioritization of surrounding air traffic on a display onboard an aircraft, the display being associated with a user input device that receives user input with respect to the display, wherein the user input designates a reference point relative to the aircraft, the system comprising:

a traffic data source configured to supply surrounding traffic data, the surrounding traffic data including at least a range of the surrounding air traffic relative to the aircraft and a vertical speed of the surrounding air traffic;

a traffic control module coupled to the traffic data source, the traffic control module receiving the user input and the surrounding traffic data, the traffic control module, configured, in response to receipt of the user input and the surrounding traffic data, to:

(a) generate a prioritization zone based on the user input such that the prioritization zone is within a predetermined range of distance from the aircraft and centered around a reference line from the aircraft to the reference point, (b) generate a first set of traffic data that includes the surrounding traffic data within the prioritization zone, (c) generate a ranked list of air traffic within the prioritization zone, the air traffic in the list ranked based upon angular proximity to the reference line, the ranked list representing a plurality of priorities corresponding to a plurality of angular proximity segments, of a plurality of aircraft comprising the air traffic in the ranked list as a preceding aircraft, and (d) generate a second set of traffic data that includes the surrounding air traffic outside of the prioritization zone listed in received sequence; and a graphical user interface manager control module coupled to the traffic control module and configured to output a graphical user interface, for display on the display, that includes the ranked list and the second set of traffic data.

2. The system of claim 1, wherein the surrounding traffic data further comprises surrounding traffic orientation data and surrounding traffic altitude data.

3. The system of claim 2, wherein the traffic control module is further configured to prioritize the surrounding air traffic based on surrounding air traffic orientation data, and further based on whether surrounding air traffic has a bearing closest to the bearing value received as the user input data or a default bearing value.

4. The system of claim 2, wherein the traffic control module is further configured to prioritize the surrounding air traffic based on surrounding traffic altitude data, and further based on whether surrounding air traffic with has an altitude value substantially equal to the altitude value received as the user input data or a default altitude value.

5. The system of claim 3, wherein based on the bearing value received as user input data or the default bearing value, the traffic control module determines a horizontal zone and the reference line relative to the aircraft, and the traffic control module prioritizes the surrounding air traffic based on proximity to the reference line within the horizontal zone.

6. The system of claim 1, wherein the graphical user interface further comprises an indicator to indicate if one or more of the preceding aircraft is outside of a viewable area of the display.

7. The system of claim 1, wherein the graphical user interface further comprises an indicator that separates the ranked list of air traffic from the second set of traffic data.

8. The system of claim 1, wherein the traffic control module is configured to prioritize the surrounding air traffic based on the range value received as user input data or a default range value.

9. A method for traffic prioritization of a plurality of surrounding air traffic aircraft relative to an ownship aircraft on a display of the ownship aircraft, the display being associated with a user input device that receives user input with respect to the display, wherein the user input designates a reference point relative to the ownship aircraft; the method comprising:

generating, by a traffic control module of the ownship aircraft, a prioritization zone based on the user input such that the prioritization zone is within a predetermined range of distances from the ownship aircraft and centered around a reference line from the ownship aircraft to the reference point;

determining, by the traffic control module, if any of the plurality of surrounding air traffic aircraft within the prioritization zone has descending vertical speeds based on surrounding traffic data supplied by a traffic data source of the ownship aircraft;

generating, by the traffic control module, a ranked list of the plurality of surrounding air traffic aircraft within the prioritization zone having the descending vertical speeds based on a bearing value of each of the plurality of surrounding air traffic aircraft relative to the ownship aircraft to prioritize the plurality of surrounding air traffic aircraft, the plurality of surrounding air traffic aircraft in the list ranked based upon angular proximity to the reference line, the ranked list representing a plurality of priorities corresponding to a plurality of angular proximity segments, of the plurality of surrounding air traffic aircraft comprising the plurality of surrounding air traffic aircraft in the ranked list as preceding aircraft;

further ordering, by the traffic control module, the ranked list based on a plurality of ranges of the plurality of surrounding air traffic aircraft from the ownship aircraft; and outputting the ranked list surrounding air traffic on the display coupled to the traffic control module to indicate a priority associated with each of the surrounding air traffic aircraft.

10. The method of claim 9, further comprising:

further prioritizing the plurality of surrounding air traffic aircraft based on an altitude of each of the plurality of the surrounding air traffic aircraft relative to the ownship aircraft.

11. The method of claim 9, further comprising:

providing a traffic graphical user interface on a display onboard at least the ownship aircraft that indicates surrounding air traffic aircraft at a selected scale; and outputting the ranked list with an indicator if at least one of the surrounding air traffic aircraft is outside the selected scale of the traffic graphical user interface.

12. The method of claim 11, wherein outputting the ranked list with the indicator further comprises:

outputting the plurality of surrounding air traffic aircraft with a first graphical indicator for each of the plurality of surrounding air traffic aircraft that is inside the selected scale of the traffic graphical user interface; and outputting the plurality of surrounding air traffic aircraft with a second, different, graphical indicator for each of the plurality of surrounding air traffic aircraft that is outside the selected scale of the traffic graphical user interface.

13. The method of claim 9, further comprising:

receiving the user input regarding a bearing value;

determining a reference vertical plane, being defined through a portion of the reference line on either side of the reference point, relative to the ownship aircraft based on the user input; and further ordering the ranked list of the plurality of the surrounding air traffic aircraft based on proximity to the reference vertical plane.

14. The method of claim 9, further comprising:

receiving the user input regarding a range value; and further ordering the ranked list of the plurality of the surrounding air traffic based on proximity to the reference point.

15. The method of claim 10, further comprising:

receiving the user input regarding an altitude value;

determining a horizontal reference plane relative to the aircraft based on the user input; and further ordering the ranked list of the plurality of the surrounding air traffic based on proximity to the horizontal reference plane.

16. A computer program product for processing a digital signal, the computer program product comprising:

a tangible, non-transitory, storage medium readable by a processing circuit and storing instructions for execution by the processing circuit for performing a method for traffic prioritization of a plurality of surrounding air traffic aircraft relative to an ownship aircraft, the method comprising:

receiving a request to activate a traffic prioritization system to enable the plurality of surrounding air traffic aircraft to be prioritized as preceding aircraft on a display onboard of an ownship aircraft, the display being associated with a user input device that receives user input with respect to the display, wherein the user input designates a reference point relative to the ownship aircraft;

receiving data regarding the plurality of surrounding air traffic aircraft from a traffic data source;

generating a prioritization zone based on the user input such that the prioritization zone is within a predetermined range of distances from the ownship aircraft and centered around a reference line from the ownship aircraft to the reference point;

determining which of the plurality of surrounding air traffic aircraft are within a prioritization zone;

determining which of the plurality of surrounding air traffic aircraft within the prioritization zone have a descending vertical speed;

if a surrounding air traffic aircraft within the prioritization zone has a descending vertical speed:

adding the surrounding air traffic aircraft to a ranked list of other surrounding air traffic aircraft also having a descending vertical speed;

further ordering the ranked list based on a bearing value of the surrounding air traffic aircraft relative to the ownship aircraft, the other surrounding air traffic aircraft in the list ranked based upon angular proximity to the reference line, the ranked list representing a plurality of priorities corresponding to a plurality of angular proximity segments, of the other surrounding air traffic aircraft comprising the plurality of surrounding air traffic aircraft in the ranked list as the preceding aircraft; and generating a visual separation approach traffic graphical user interface for display onboard the ownship aircraft that displays the ranked list to enable the selection of one at least one of the plurality of the surrounding air traffic aircraft as a preceding air traffic for a visual separation approach.

17. The computer program product of claim 16, wherein the method further comprises:

further ordering the ranked list of plurality of the surrounding air traffic aircraft based on a plurality of ranges of the plurality of the surrounding air traffic aircraft relative to the ownship aircraft.

18. The computer program product of claim 16, wherein the method further comprises:

further ordering the ranked list of the plurality of surrounding air traffic aircraft based on a plurality of altitudes of the surrounding air traffic aircraft relative to the ownship aircraft.

* * * * *